US009562690B2

(12) United States Patent
Cheung

(10) Patent No.: US 9,562,690 B2
(45) Date of Patent: Feb. 7, 2017

(54) SWIRLER, FUEL AND AIR ASSEMBLY AND COMBUSTOR

(71) Applicant: UNITED TECHNOLOGIES CORPORATION, Farmington, CT (US)

(72) Inventor: Albert K. Cheung, East Hampton, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/456,685

(22) Filed: Aug. 11, 2014

(65) Prior Publication Data

US 2016/0209036 A1 Jul. 21, 2016

Related U.S. Application Data

(63) Continuation of application No. 12/823,398, filed on Jun. 25, 2010, now Pat. No. 8,850,819.

(51) Int. Cl.

| | |
|---|---|
| ***F02C 1/00*** | (2006.01) |
| ***F23R 3/28*** | (2006.01) |
| *F23R 3/14* | (2006.01) |

(52) U.S. Cl.

CPC . *F23R 3/286* (2013.01); *F23R 3/14* (2013.01)

(58) Field of Classification Search

CPC ..... F23R 3/10; F23R 3/12; F23R 3/14; F23R 3/286; F23R 3/002

See application file for complete search history.

(56) References Cited

U.S. PATENT DOCUMENTS

| | | | | |
|---|---|---|---|---|
| 3,811,278 A | | 5/1974 | Taylor et al. | |
| 3,946,552 A | | 3/1976 | Weinstein et al. | |
| 4,653,278 A | | 3/1987 | Vinson et al. | |
| 5,417,070 A | | 5/1995 | Richardson | |
| 5,490,378 A | * | 2/1996 | Berger | F23R 3/26 60/39.23 |
| 5,592,819 A | * | 1/1997 | Ansart | F23R 3/12 60/737 |
| 5,603,211 A | | 2/1997 | Graves | |
| 5,966,937 A | | 10/1999 | Graves | |
| 6,161,387 A | | 12/2000 | Green | |
| 6,253,555 B1 | | 7/2001 | Willis | |

(Continued)

FOREIGN PATENT DOCUMENTS

| | | |
|---|---|---|
| EP | 0636835 A2 | 2/1995 |
| EP | 0803681 A1 | 10/1997 |

(Continued)

OTHER PUBLICATIONS

English Abstract for EP0803681A1—Oct. 29, 1997; 2 pgs.

(Continued)

*Primary Examiner* — Gerald L Sung

(74) *Attorney, Agent, or Firm* — Cantor Colburn LLP

(57) ABSTRACT

An air swirler, a fuel and air admission assembly, and a staged combustor are disclosed. The staged combustor may be equipped with the fuel and air admission assemblies incorporating the air swirlers for use in gas turbine engines, such as for example gas turbine engines powering aircraft having supersonic cruise capability.

5 Claims, 4 Drawing Sheets

(56) References Cited

U.S. PATENT DOCUMENTS

| | | | | |
|---|---|---|---|---|
| 6,360,525 | B1 * | 3/2002 | Senior | F23R 3/12 60/747 |
| 6,962,055 | B2 | 11/2005 | Chen et al. | |
| 7,107,772 | B2 | 9/2006 | Chen et al. | |
| 7,237,384 | B2 | 7/2007 | Stuttaford et al. | |
| 7,334,410 | B2 | 2/2008 | Creighton et al. | |
| 7,506,511 | B2 | 3/2009 | Zupanc et al. | |
| 7,509,811 | B2 | 3/2009 | Chen et al. | |
| 7,581,396 | B2 | 9/2009 | Hsieh et al. | |
| 2002/0017101 | A1 * | 2/2002 | Schilling | F23R 3/06 60/747 |
| 2004/0025508 | A1 | 2/2004 | Calvez et al. | |
| 2008/0060361 | A1 | 3/2008 | Morrison et al. | |
| 2009/0113893 | A1 | 5/2009 | Li et al. | |

FOREIGN PATENT DOCUMENTS

| | | | |
|---|---|---|---|
| EP | 1600693 | A2 | 11/2005 |
| EP | 2014988 | A1 | 1/2009 |
| FR | 2243332 | A1 | 4/1975 |

OTHER PUBLICATIONS

English Abstract for EP2014988A1—Jan. 14, 2009; 2 pgs.
European Search Report for Application No. 11250606.8-1605; Date of Mailing: Jun. 22, 2015; 7 pgs.

* cited by examiner

SWIRLER, FUEL AND AIR ASSEMBLY AND COMBUSTOR

CROSS-REFERENCE TO RELATED APPLICATIONS

This application is continuation application pursuant to 35 U.S.C. §120 of U.S. patent application Ser. No. 12/823,398 filed on Jun. 25, 2010.

STATEMENT OF GOVERNMENT INTEREST

The United States Government has certain rights in this disclosure pursuant to contract number NNC08CA92C between the National Aeronautics and Space Administration and United Technologies Corporation.

FIELD OF THE INVENTION

This invention relates generally to gas turbine engines and, more particularly, to a fuel injector and air swirler assembly that improves mixing of gaseous fuel and air a combustor embodying a plurality of radially and axially staged swirler assemblies.

BACKGROUND OF THE INVENTION

Gas turbine engines, such as those used to power modern commercial aircraft, include a compressor for pressurizing a supply of air, a combustor for burning a hydrocarbon fuel in the presence of the pressurized air, and a turbine for extracting energy from the resultant combustion gases. In aircraft engine applications, the compressor, combustor and turbine are disposed about a central engine axis with the compressor disposed axially upstream of the combustor and the turbine disposed axially downstream of the combustor.

Combustion of the hydrocarbon fuel in air in gas turbine engines inevitably produces emissions, such as oxides of nitrogen (NOx), carbon monoxide and hydrocarbons, which are delivered into the atmosphere in the exhaust gases from the gas turbine engine. It is generally accepted that oxides of nitrogen are produced at high flame temperatures. One approach to lower NOx emissions is to lower flame temperature by operating the combustor under fuel lean conditions. However, during operation of the combustor under fuel lean conditions, combustion instability and flame-out may occur if the fuel and air mixture becomes too fuel lean. Additionally, during operation of the combustor under fuel lean conditions, the lower flame temperatures could result in incomplete combustion and a consequent increase in carbon monoxide and hydrocarbons emissions.

Another approach to lower the emissions of oxides of nitrogen, carbon monoxide and hydrocarbons from a gas turbine engine is through staged combustion. In one arrangement for implementing staged combustion in a gas turbine engine is to provide a plurality of fuel injection nozzles and associated air swirler assemblies, of which only a selected portion are operated at engine idle and under low power demands and all of which are operated at engine cruise and under high power demands.

In general, it is desirable to rapidly mix the fuel and the air in an attempt to provide uniform fuel lean conditions and eliminate as many local pockets of combustion under near stoichiometric fuel/air conditions to avoid pockets of high flame temperature conducive to NOx formation or of combustion under fuel rich conditions to avoid carbon monoxide and hydrocarbon resulting from incomplete combustion.

Various designs of swirler assemblies have been developed for use in association fuel injection nozzles in an attempt to provide rapid fuel and air mixing. For example, U.S. Pat. No. 5,966,937 discloses a fuel injector and a two-pass air swirler disposed about the fuel injector, the air swirler having an inner swirled air passage and an outer swirled air passage. The fuel is injected through the end of the fuel injector into the swirling airflow generated by the inner air swirler. U.S. Pat. No. 5,603,211 discloses a fuel injector and a three-pass air disposed about the fuel injector, the air swirler having an inner swirled air passage, an intermediate swirled air passage and an outer swirled air passage. Again, the fuel is injected through the end of the fuel injector into the swirling airflow generated by the inner air swirler.

There is a desire for an efficient, low-emission, and stable combustor for use in gas turbine engines for powering supersonic cruise vehicles. It is contemplated that combustors in gas turbine engines for powering supersonic cruise vehicles will operate with pre-vaporized, that is gaseous, jet fuel. While the aforementioned air swirlers have performed well in mixing liquid jet fuel and air in conventional gas turbine engines on commercial subsonic aircraft, there is a desire for an air swirler assembly that provides rapid and efficient mixing of gaseous jet fuel with air.

SUMMARY OF THE INVENTION

In an aspect, a swirler assembly is provided for a combustor having a fuel injector extending along a central longitudinal axis. The swirler assembly includes a body having a central opening for receiving the fuel injector and defining a unitary fuel and air mixing chamber having an open downstream end and extending about the downstream of a tip end of said fuel injector. The swirler body also defines a first inner air passage opening into an upstream end of the mixing chamber and disposed coaxially about the fuel injector and a second inner air passage opening into the upstream end of the mixing chamber downstream of the first inner air passage. The body also defines an outer air passage opening externally of the mixing chamber and disposed coaxially about the downstream open end of the mixing chamber. An air flow passing through the second inner air passage has a swirl imparted thereto that is counter-directional to a swirl imparted to an air flow passing through the first inner air passage. In an embodiment, the swirler body further includes a plurality of fuel injection ports extending through the swirler body at circumferentially spaced intervals and opening into the upstream end of the mixing chamber. In an embodiment, an air flow passing through the outer air passage has a swirl imparted thereto that is co-directional to a swirl imparted to an air flow passing through the first inner air passage.

In an aspect, a fuel and air admission assembly is provided for a combustor. The fuel and air admission assembly includes a fuel injector extending along a central longitudinal axis and a swirler assembly having a body mounted on the fuel injector and defining a fuel and air mixing chamber having an open downstream end and extending about and downstream of a tip end of the fuel injector. The fuel injector includes a plurality of inner fuel ports opening into the mixing chamber and the swirler body has a plurality of outer fuel injection ports extending through the swirler body to open into the mixing chamber. A first portion of the fuel may be injected into an upstream region of the mixing chamber through the plurality of inner fuel ports and a second portion of fuel may be injected generally inwardly into the upstream end of the mixing chamber through the plurality of outer fuel ports. The swirler assembly may further include a first inner air passage opening into an upstream end of the mixing chamber and disposed coaxially about the fuel injector, a second inner air passage opening into the upstream end of the mixing chamber, and an outer air passage opening externally of the mixing chamber. An air flow passing through the second inner air passage has a swirl imparted thereto that is counter-directional to a swirl imparted to an air flow passing through the first inner air passage and an air flow passing through the outer air passage has a swirl imparted thereto that is co-directional to the swirl imparted to an air flow passing through the first inner air passage.

In an aspect, a radially and axially staged combustor is provided. The combustor includes a circumferentially extending inner liner, a circumferentially extending outer liner spaced radially outward from and circumscribing the inner liner, and a radially and axially stepped annular bulkhead extending between an upstream end of the inner liner and an upstream end of the outer liner. The stepped bulkhead has a radially inwardmost first bulkhead segment, a radially intermediate second bulkhead segment disposed axially downstream of the first bulkhead segment, and a radially outermost third bulkhead segment disposed axially downstream of the second bulkhead segment. A plurality of first fuel and air admission assemblies are disposed in the first bulkhead segment. A plurality of second fuel and air admission assemblies are disposed in the second bulkhead segment. A plurality of third fuel and air admission assemblies are disposed in the third bulkhead segment.

In an embodiment of the combustor, the plurality of first fuel and air admission assemblies are arranged in the first bulkhead segment at equal circumferentially spaced intervals, the plurality of second fuel and air admission assemblies are arranged in the second bulkhead segment in paired sets, the paired sets disposed at equal circumferentially spaced intervals, and the plurality of third fuel and air admission assemblies are arranged in the third bulkhead segment in paired sets, the paired sets disposed at equal circumferentially spaced intervals. In an embodiment, a first of each paired set of the second fuel and air admission assemblies admits a mixed flow of fuel and air with a prevailing counter-clockwise swirl and a second of each paired set of the second fuel and air admission assemblies admits a mixed flow of fuel and air with a prevailing clockwise swirl. Similarly, a first of each paired set of the third fuel and air admission assemblies admits a mixed flow of fuel and air with a prevailing counter-clockwise swirl and a second of each paired set of the third fuel and air admission assemblies admits a mixed flow of fuel and air with a prevailing clockwise swirl.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
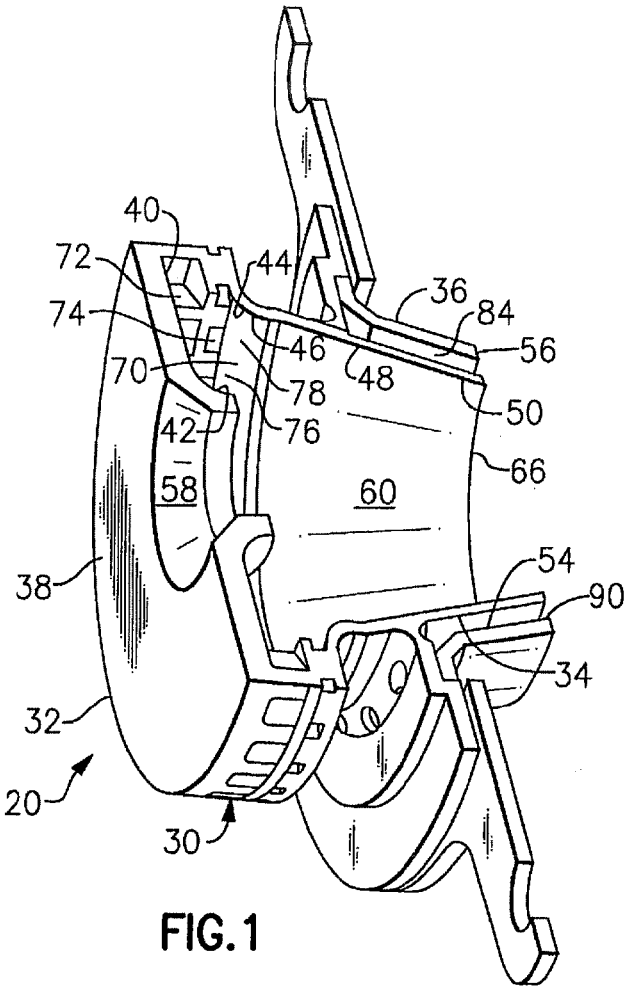
FIG. 1 is a perspective view of an embodiment of an air swirler assembly as disclosed herein.
Figure 3:
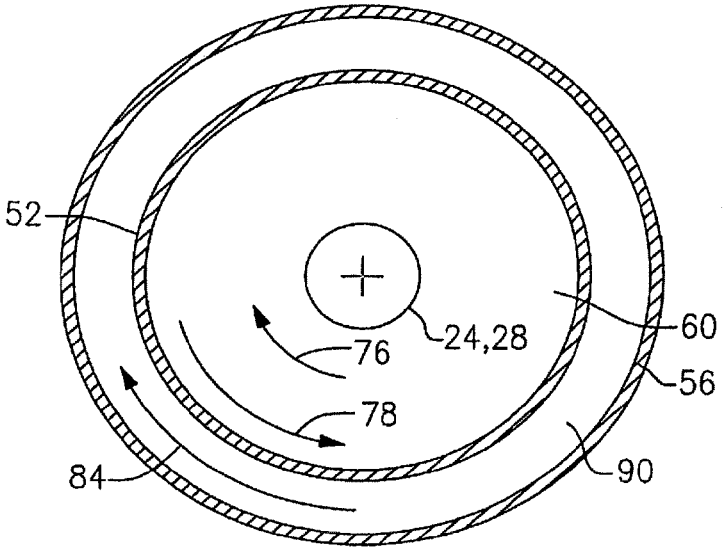
FIG. 3 is a cross-sectional view of the assembly of FIG. 2 taken along line 3-3.
Figure 2:
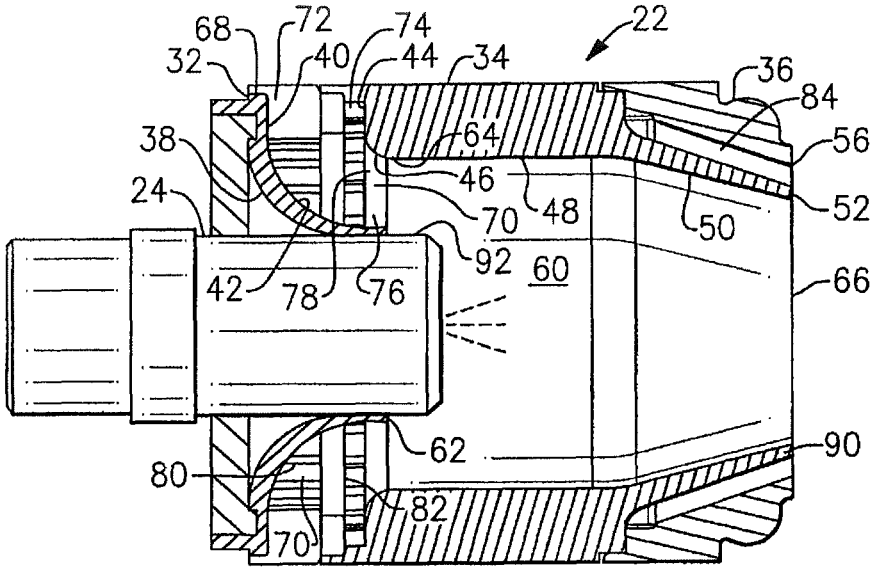
FIG. 2 is a sectioned side elevation view of an embodiment of a fuel injector and air swirler assembly embodying the air swirler assembly of FIG. 1.
Figure 4:
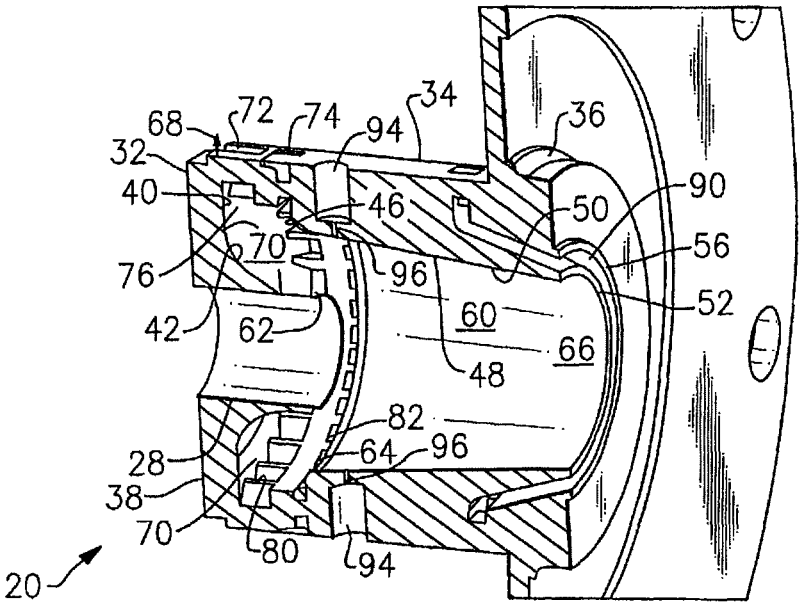
FIG. 4 is a perspective view of another embodiment of an air swirler assembly as disclosed herein.
Figure 5:
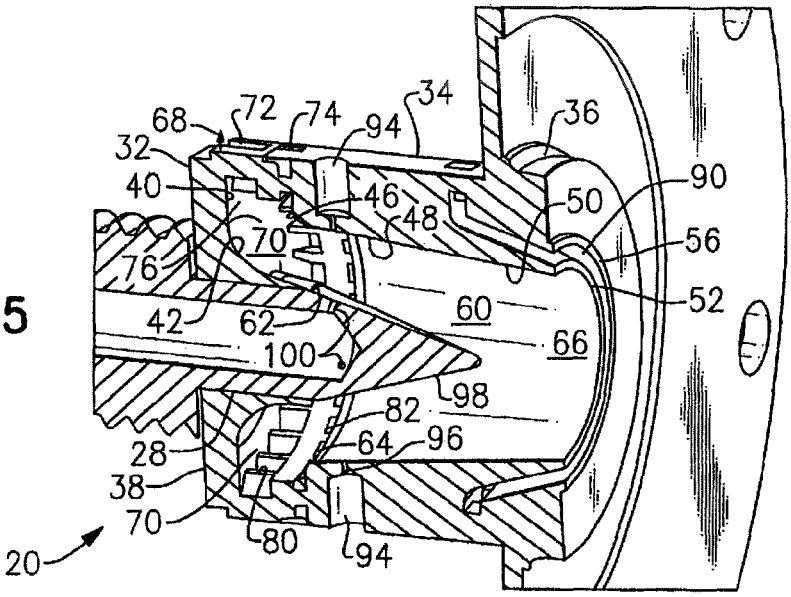
FIG. 5 is a perspective view of an embodiment of a fuel injector and air swirler assembly embodying the air swirler assembly of FIG. 4.
Figure 6:
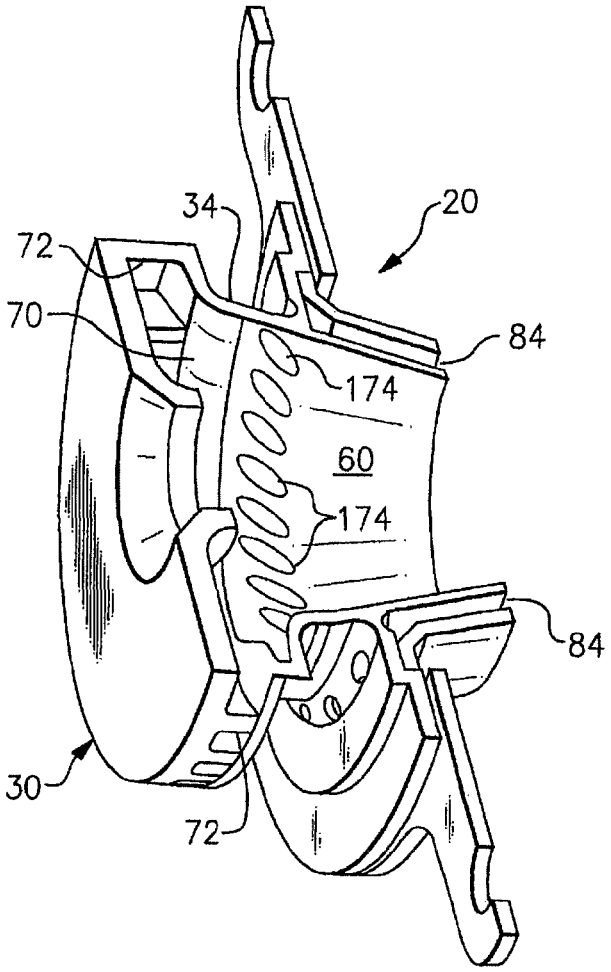
FIG. 6 is a perspective view of still another embodiment of an air swirler assembly as disclosed herein.

Referring initially to FIGS. 1-6, an air swirler 20 in accord with the disclosure is depicted in a first exemplary embodiment in FIGS. 1-3, in a second exemplary embodiment in FIGS. 4 and 5, and in a third exemplary embodiment in FIG. 6. In FIG. 2, the first embodiment of the air swirler 20 is shown in assembly 22 with a fuel injector 24. In FIG. 5, the second embodiment of the air swirler 20 is shown in assembly 26 with a fuel injector 28. Throughout the drawings, like items are referred to with a common reference numeral. Additionally, with reference to the drawings, the terms "forward" and "upstream" refer to the generally leftward and the terms "aft" and "downstream" refer to the generally rightward direction of the viewer.

The air swirler 20 has a body 30 having a forward member 32, commonly referred to as a bearing plate, a central member 34 and an aft member 36. The forward member 32 includes a forward surface 38 and an aft surface 40, the aft surface including a generally concave curved surface section 42. The central member 34 includes a forward surface 44 including a generally convex curved surface section 46, an interior surface 48, and generally conical aft interior surface 50 converging to an aft rim 52. The aft member 36 includes a generally conical interior surface 54 that faces in spaced relationship the aft exterior surface of the central member 34 and converges to an aft rim 56 that circumscribes in spaced relationship the aft rim 52 of the central member 34. The interior surface 48 of the central member is depicted in FIGS. 1 and 4-6 as a conical surface converging uniformly with the aft interior surface 50, and is depicted in FIG. 2 as a cylindrical surface forward of the conical aft interior surface 50. However, the interior surface 48 of the central member 34 is not limited to the depicted configurations.

The forward member 32 also has a central opening 58 extending axially therethrough along a longitudinal axis. The central opening 58 is sized to receive and closely accommodate a fuel injector. The body 30 also defines a unitary fuel and air mixing chamber 60, also referred to as a mixing cup, coaxially about the same longitudinal axis and that is circumscribed by the interior surface 48 and the aft interior surface 50 of the central member 34. The mixing chamber 60 has an open annular inlet end extending generally between the aft rim 62 of the forward member 32 and the forward end 64 of the interior surface 48 of the central member 34 and an open outlet end 66 circumscribed by an aft rim 52 of central member 34. When the air swirler 20 is embodied in the fuel and air admission assemblies 22, 26, as illustrated in FIGS. 3 and 5, respectively, the mixing chamber 60 extends about and downstream of a distal end of the fuel injector 24, 28.

The aft surface 40 of the forward member 32 extends from a perimeter rim at the exterior surface 68 of the body 30 radially inward, transitionally into the generally concave curved surface section 42 and terminating at the aft rim 62. The forward surface 44 of the central member 34 extends radially inward from a perimeter rim at the exterior surface 68 of the body 30 transitioning into the generally convex curved surface section 46 and extending to the forward end 64 of the interior surface 34. The aft surface 40 of the forward member 32 and the forward surface 44 of the central member 34 generally cooperate to define an interior passage 70 that opens into an upstream end of the mixing chamber 60 through the annular inlet end of the mixing chamber 60 extending generally between the aft rim 62 of the forward member 32 and the forward end 64 of the interior surface 48 of the central member 34.

Referring now in particular to FIGS. 1-5, plurality of first air inlets 72 disposed at circumferentially intervals about the circumference of the exterior surface 68 of the body 30 along the aft perimeter rim of the forward member 32 open into the interior passage 70. Additionally, a plurality of second air inlets 74 disposed at circumferentially intervals about the circumference of the exterior surface 68 of the body 30 along the forward perimeter rim of the central member 34 open into the interior passage 70. A first supply of air, also referred to herein as primary air, is admitted to the swirler 20 through the plurality of first air inlets 72 to flow along the aft surface 40 of the forward member 32. A second supply of air, also referred to herein as secondary air, is admitted to the swirler 20 through the plurality of second air inlets 74 to flow along the forward surface 44 of the central member 34. Therefore, in the first and second exemplary embodiments of the air swirler 20, the interior passage 70 embodies both a first inner air passage 76 and a second inner air passage 78, the second inner air passage 78 being disposed about the first inner air passage 76.

A circumferential array of swirl vanes 80 and 82 are disposed in the inlet portions, respectively, of each of the first inner air passage 76 and the second inner air passage 78. The circumferential array of swirl vanes 80 impart a swirl to the primary air admitted through the plurality of first air inlets and flowing along the first inner air passage 76. The circumferential array of swirl vanes 82 impart a swirl to the secondary air admitted through the plurality of second air inlets and flowing along the second inner air passage 78. The circumferential array of swirl vanes 80 are twisted or otherwise constructed to impart a swirl to the primary air in a first rotational direction, while the circumferential array of vanes 82 are twisted or otherwise constructed to impart a swirl to the secondary air in a second rotational direction counter to the first rotational direction, as illustrated in FIG. 3.

In this manner, the secondary air flowing along the second inner air passage 78 flows through the interior pass 70 about the primary air flowing along the first inner air passage 76 in counter-rotation to the primary air. Thus, if the primary air flowing through the interior pass 70 is swirled to rotate in a clockwise direction, the secondary air flowing through the interior pass 70 is swirled to rotate in a counter-clockwise direction. However, if the primary air flowing through the interior pass 70 is swirled to rotate in a counter-clockwise direction, then the secondary air flowing through the interior pass 70 is swirled to rotate in a clockwise direction.

Additionally, an outer air passage 84 is formed in the body 30 between the aft exterior surface 50 of the central member 34 and the facing interior surface 48 of the aft member 36. A plurality of third air inlets 86 disposed at circumferentially intervals about the circumference of the exterior surface 68 of the body 30 along the forward perimeter rim of the aft member 36 open into the outer air passage 84. A circumferential array of swirl vanes 88 is disposed in the inlet portion of the exterior air passage 84. The circumferential array of swirl vanes 88 impart a swirl to a flow of tertiary air admitted through the plurality of third air inlets and flowing through the outer air passage 84. The tertiary air exits the outer air passage 84 through the annular gap 90, formed between the aft rim 52 of the central member 34 and the aft rim 56 of aft member 36 that circumscribes in spaced relationship the aft rim 52, in a swirling flow about the fuel and air passing mixture flowing through the outlet 66 of the mixing chamber 60. The circumferential array of vanes 88 are twisted or otherwise constructed to impart a swirl to the tertiary air that is co-directional in rotation with the primary air.

Referring now to FIG. 2 in particular, the first embodiment of the swirler 20 is shown mounted to the fuel injector 24 in the fuel and air admission assembly 22. The fuel injector 24 has a distal end outlet 92 through which a spray of fuel, for example a gaseous fuel, such as pre-vaporized Jet A fuel, is injected outwardly into the mixing chamber 60 in a radially and axially diverging cone. The swirler 20 and fuel injector 24 are centrally disposed about a common longitudinal axis (not shown). The fuel sprayed into the mixing chamber 60 first encounters and mixes with the primary air flow passing along the first inner air passage 76. As the fuel is propelled further outwardly, partially under its own momentum and partly due to centrifuge-like effect of the swirling primary air, the fuel and primary air encounters the counter-swirling secondary air flow passing along the second inner air passage 78. The counter-swirling secondary air decreases the radial momentum of the fuel and mixes with the fuel and primary air flow. In this manner, the fuel is more rapidly and more uniformly mixed than with conventional prior art fuel and air admission assemblies wherein the fuel is introduced into a mixing chamber with air rotating in only one general direction.

To the extent heretofore described, the described elements of the swirler 20 are common to both the first embodiment of the swirler 20 depicted in FIG. 1 and the second embodiment of the swirler 20 depicted in FIG. 4. However, referring now to FIG. 4 in particular, the second embodiment of the swirler 20 as depicted therein, includes a plurality of fuel ports 94 provided in the swirler body 30. The plurality of fuel ports 94 are disposed at circumferentially spaced intervals about the circumference of the central member 34 near the forward end thereof. Each fuel port 94 opens at its inboard through an orifice 96 that opens on the interior surface 48 of the central member 34 to the mixing chamber 60. Each fuel port 94 and corresponding orifice 96 may be aligned along a radial axis whereby the fuel injected into the mixing chamber 60 is injected along an axis normal to the interior surface 48.

Referring now to FIG. 5 in particular, the second embodiment of the swirler 20 is shown mounted to the fuel injector 28 in the fuel and air admission assembly 26. The swirler 20 and fuel injector 28 are centrally disposed about a common longitudinal axis (not shown). The fuel injector 28 has a distal end nose cone 98 that extends from the aft rim 62 of the forward member 32 into the mixing chamber 60. The exterior surface of the nose cone 98 provides an aerodynamic surface along which the swirling primary air flows upon entering the mixing chamber 60 from the first inner air passage 76. A plurality of fuel orifices 100 is provided in the nose cone 98 at circumferentially spaced intervals about the circumference of the aft portion of the nose cone 98. Each fuel orifice 100 provides a path through which fuel, for example a gaseous fuel, such as pre-vaporized Jet A fuel, is injected outwardly into an upstream region of the mixing chamber 60. Each orifice 100 may be aligned along an axis normal to the exterior surface of the nose cone 98 whereby the fuel injected into the mixing chamber 60 is injected along an axis normal to the exterior surface of the nose cone 98.

In the fuel and air admission assembly 26, only a first portion of the fuel is admitted into the mixing chamber 60 through the fuel injector 28 by way of the orifices 100. A second portion of the fuel is admitted into the mixing chamber 60 through the orifices 96 associated with the plurality of fuel ports 94 in the body 30 of the swirler 20. As depicted in FIG. 5, when the swirler 20 is assembled on the fuel injector 28, the orifices 96 are position in relative axial alignment with the orifices 100 in the fuel injector 28. Thus, fuel is introduced into the upstream region of the mixing chamber 60 simultaneously through both the orifices 94 in the swirler 20 and the orifices 100, with the fuel introduced through the orifices 100 being injected into the swirling primary air flow passing into the mixing chamber 60 from the first inner air passage 76 and the fuel introduced through the orifices 94 being injected into the counter-swirling secondary air flow passing into the mixing chamber 60 from the second inner air passage 78.

The injection of fuel not only into the swirling primary air flow through a set of inner fuel injection holes formed by the plurality of orifices 100 in the fuel injector 28, but also simultaneously into the counter-swirling secondary air flow in the upstream region of the mixing chamber 60 through a set of outer fuel injection ports formed by the plurality of orifices 96 in the body of the air swirler 20 provides for a more distributed initial mixing of the fuel and air which leads to a higher mixing rate and resultant more uniform distribution of the fuel within the air within the mixing chamber 60 when the counter-rotating flows of mixed fuel and primary and mixed fuel and secondary turbulently interact at the interface therebetween as the flows pass aftward through the mixing chamber 60.

Additionally, adjustment of the distribution of both fuel to be admitted between the inner orifices 100 and the outer orifices 94, as well as adjustment of the distribution of air to be admitted between the primary air and the secondary air flows to the mixing chamber 60 provide the ability to optimize the relative distribution to achieve the fast mixing rate and the most uniform fuel lean distribution while maintaining a reasonable margin to avoid auto-ignition issues. For example, the air admitted into the upstream end of the mixing chamber 60 may be split between the primary air flow and the secondary air flow in a ratio ranging from 9 parts primary air to 1 part secondary air to 1 part primary air to 9 parts secondary air. As the amount of secondary air flow to the primary air flow increases, the shear interface between the primary and secondary air flows migrates radially outward within the interior passage 70. At high primary to secondary air flow ratios, the shear interface will lie nearer to the radially inboard side of the interior passage 70. Conversely, at low primary to secondary air flow ratios, the shear interface will lie nearer to the radially outward side of the interior air passage 70.

Referring now in particular to FIG. 6, there is depicted another embodiment of the sir swirler 20. In this embodiment, the flow of secondary air is admitted into the mixing chamber 60 through a plurality of second air inlets 174 spaced axially downstream of the plurality first air inlets 72, rather than being disposed axially adjacent to the plurality of first air inlets 72 as in the embodiment depicted in FIG. 1. In the embodiment depicted in FIG. 6, the plurality of second air inlets 174 comprises a ring of circumferentially spaced air admission ports opening through the central member 34 of the swirler body 30 in a central axial span of the central member 34. Each of the second air inlets 174 is oriented such that the secondary air passing therethrough is admitted into the mixing chamber 60 in counter-rotation, as illustrated in FIG. 3, to the flow of the primary air admitted through the plurality of first air inlets 72 and passing through the mixing chamber 60 in a rotating flow. Thus, a high turbulence mixing zone is created at the shear interface between the counter-rotating flows of primary air and secondary air in the mixing chamber 60 downstream of the introduction of the secondary air through the plurality of second air inlets 174. The high turbulence at the shear interface enhances mixing of the fuel entrained in the primary air flow with the secondary air flow introduced into the central axial span of the mixing chamber 60.

The embodiments of the air swirler 20 depicted in FIGS. 1, 2 and 6 and the fuel and air admission assemblies 22 and 26 are well suited for use in connection with combustors for gas turbine engines, such as, for example, aircraft engines. The fuel and air admission assembly 26 is particularly well suited for use in connection with gas turbine engines for powering aircraft having supersonic cruise capability. The air swirler 20 and the fuel and air admission assemblies 22 and 26 are also well suited for use in connection with gas turbine engine combustors such as low emission combustors. The embodiment of the air swirler 20 depicted in FIG. 1 is well suited for use in connection with gas turbine combustors burning gaseous fuel such as pre-vaporized Jet A fuel. The embodiment of the air swirler 20 depicted in FIG. 6 is well suited for use in connection with gas turbine combustors burning liquid fuel such as Jet A fuel.

Figure 7:
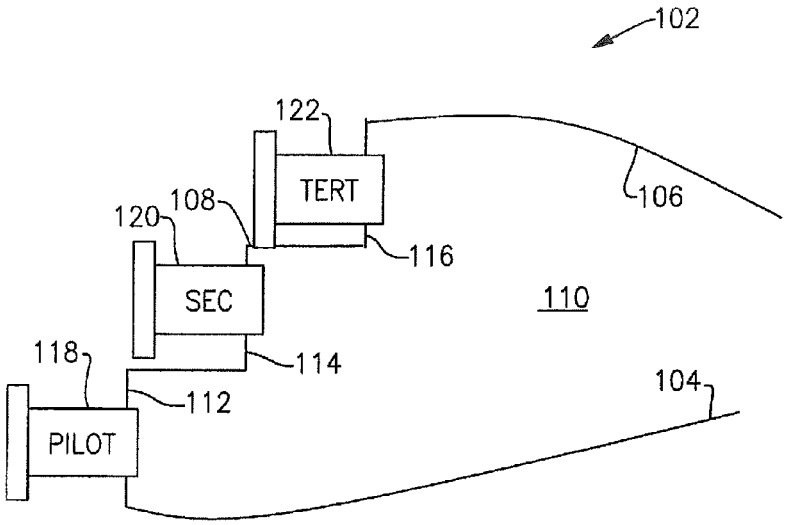
FIG. 7 is a schematic sectioned side elevation illustration of a gas turbine engine combustor having a plurality of fuel injection nozzles and associated air swirler assemblies arranged in a staged combustion array.
Figure 8:
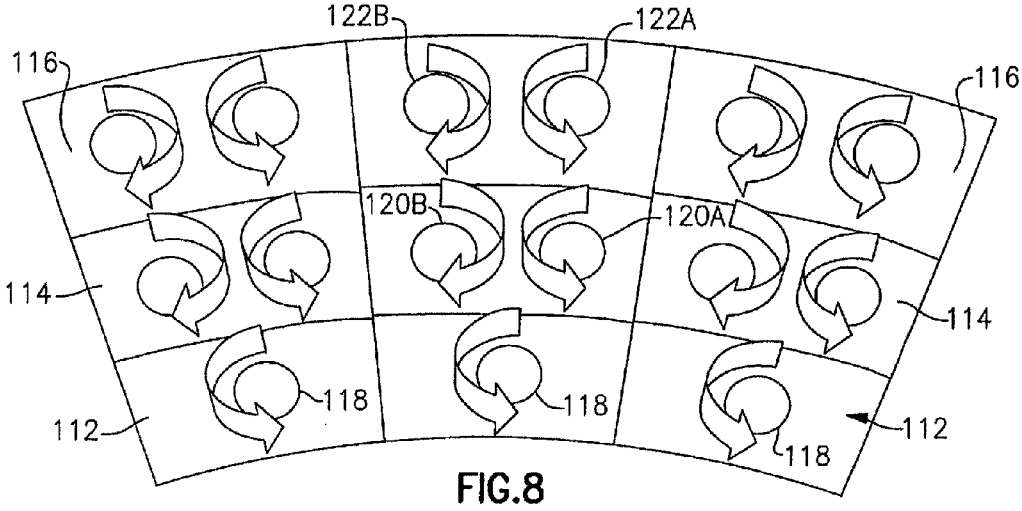
FIG. 8 is a schematic sectioned elevation illustration of the gas turbine combustor of FIG. 7 looking forward as taken substantially along line 8-8.

Referring now to FIGS. 7 and 8, there is depicted an exemplary embodiment of a fuel-staging combustor 102 for a gas turbine engine. The combustor 102 includes a circumferentially extending inner liner 104, a circumferentially extending outer liner 106 spaced radially outward from and circumscribing the inner liner 104, and a radially and axially stepped annular bulkhead 108 extending between a foreward end of the inner liner 104 and a foreward end of the outer liner 106, thereby defining an annular combustion chamber 110. The inner liner 104 and the outer liner 106 may be of conventional materials and conventional construction, for example single-walled or double-walled, the particulars of the inner and outer liners not being germane to the invention.

The stepped bulkhead 108 has a radially inwardmost first bulkhead segment 112, a radially intermediate second bulkhead segment 114 disposed axially downstream of the first bulkhead segment 112, and a radially outermost third bulkhead segment 116 disposed axially downstream of the second bulkhead segment 114. A plurality of first fuel and air admission assemblies 118 are disposed in a circumferential array in the first bulkhead segment 112. A plurality of second fuel and air admission assemblies 120 are disposed in a circumferential array in the second bulkhead segment 114. A plurality of third fuel and air admission assemblies 122 are disposed in a circumferential array in the third bulkhead segment 116. In an embodiment, each of the fuel and air admission assemblies 118, 120, 122 may comprise an embodiment of the fuel and air admission assembly 22 or an embodiment of the fuel and air admission assembly 26 and may utilize an embodiment of the air swirler 20.

Thus, in the combustor 102, combustion within the combustion chamber 110 is staged both radially and axially. A first portion of fuel and a first portion of air may admitted through the plurality of first fuel and air admission assemblies 118, a second portion of fuel and a second portion of air may admitted through the plurality of second fuel and air admission assemblies 120, and a third portion of fuel and a third portion of air may admitted through the plurality of third fuel and air admission assemblies 122. The relative distribution of the fuel and of the air may be selectively adjusted amongst the three sets of fuel and air admission assemblies 118, 120, 122 to control the overall fuel/air ratio of each the sets 118, 120, 122 of fuel and air admission assemblies. For example, the distribution of fuel or of air or of both fuel and air may be selectively adjusted to ensure that all three sets 118, 120, 122 of fuel and air admission assemblies operate at a fuel-lean fuel/air ratio during engine operation at cruise for low NOx emission production, and readjusted during engine operation at idle or low power to ensure that one set of the fuel and air admission assemblies, for example the radially innermost set 118, are operated at a near stoichiometric fuel/air ratio or a slightly fuel-rich fuel/air ratio to ensure flame and ignition stability.

In an embodiment of the radially and axially staged combustor 102, as depicted in FIG. 8, the plurality of first fuel and air admission assemblies 118 are arranged in the first bulkhead segment 112 in a circumferential array and spaced apart at equally circumferentially spaced intervals, the plurality of second fuel and air admission assemblies 120 are arranged in the second bulkhead segment 114 in paired sets 120A, 120B with the paired sets disposed in a circumferential array and spaced apart at equal circumferentially spaced intervals, and the plurality of third fuel and air admission assemblies 122 are arranged in the third bulkhead segment 116 in paired sets 122A, 122B with the paired sets disposed in a circumferential array and spaced apart at equal circumferentially spaced intervals.

In the depicted embodiment, a first 120A of each paired set of the second fuel and air admission assemblies 120 admits a mixed flow of fuel and air with a prevailing counter-clockwise swirl into the combustion chamber 110 and a second 120B of each paired set of the second fuel and air admission assemblies 120 admits a mixed flow of fuel and air with a prevailing clockwise swirl into the combustion chamber 110. Similarly, a first 122A of each paired set of the third fuel and air admission assemblies 122 admits a mixed flow of fuel and air with a prevailing counter-clockwise swirl into the combustion chamber 110 and a second 122B of each paired set of the third fuel and air admission assemblies 122 admits a mixed flow of fuel and air with a prevailing clockwise swirl into the combustion chamber. In this embodiment, the bulkhead 108 includes a plurality of sectors 124 of equal circumferential arc extent. Each sector 124 includes a single first fuel and air admission assembly 118 disposed in the first bulkhead segment 112, a single paired set of second fuel and air admission assemblies 120 disposed in the second bulkhead segment 114, and a single paired set of third fuel and air admission assemblies 122 in the third bulkhead segment 116. Although only three sectors are illustrated in FIG. 8, it is to be understood that the plurality of sectors extend circumferentially around the entire circumferential extent of the stepped bulkhead 108. Those skilled in the art will understand that the actual number of sectors 124 with five fuel and air admission assemblies arranged in each sector as hereinbefore described may vary with combustor application and gas turbine engine requirements.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

I claim:

1. A combustor for a gas turbine engine comprising:

a circumferentially extending inner liner;

a circumferentially extending outer liner spaced radially outward from and circumscribing the inner liner;

a radially and axially stepped annular bulkhead extending between an upstream end of the inner liner and an upstream end of the outer liner, the stepped bulkhead having a radially inwardmost first bulkhead segment, a radially intermediate second bulkhead segment disposed axially downstream of the first bulkhead segment, and a third radially outermost bulkhead segment disposed axially downstream of the second bulkhead segment;

a plurality of first fuel and air admission assemblies disposed in the first bulkhead segment;

a plurality of second fuel and air admission assemblies disposed in the second bulkhead segment; and a plurality of third fuel and air admission assemblies disposed in the third bulkhead segment, at least one of the plurality of first, second and third fuel and air admission assemblies including a swirler body defining a unitary fuel and air mixing chamber extending from an upstream end, defined by a forward member, to a downstream end having an opening and with first and second inner air passages in fluid communication with each other in a single interior passage without any partition therebetween, the first and second air passages in communication with first and second air inlets opening radially into the single interior passage, the single interior passage opening into the upstream end of the mixing chamber.

2. The combustor as recited in claim 1 wherein:

the plurality of first fuel and air admission assemblies are arranged in the first bulkhead segment at equal circumferentially spaced intervals;

the plurality of second fuel and air admission assemblies are arranged in the second bulkhead segment in paired sets, the paired sets disposed at equal circumferentially spaced intervals; and the plurality of third fuel and air admission assemblies are arranged in the third bulkhead segment in paired sets, the paired sets disposed at equal circumferentially spaced intervals.

3. The combustor as recited in claim 2 wherein a first of each paired set of the second fuel and air admission assemblies admits a mixed flow of fuel and air with a prevailing counter-clockwise swirl and a second of each paired set of the second fuel and air admission assemblies admits a mixed flow of fuel and air with a prevailing clockwise swirl.

4. The combustor as recited in claim 3 wherein a first of each paired set of the third fuel and air admission assemblies admits a mixed flow of fuel and air with a prevailing counter-clockwise swirl and a second of each paired set of the third fuel and air admission assemblies admits a mixed flow of fuel and air with a prevailing clockwise swirl.

5. The combustor as recited in claim 4 wherein said bulkhead includes a plurality of sectors of equal circumferential arc extent, each sector including a single first fuel and air admission assembly disposed in the first bulkhead segment, a single paired set of second fuel and air admission assemblies disposed in the second bulkhead segment, and a single paired set of third fuel and air admission assemblies in the third bulkhead segment.

* * * * *